US011453036B2

(12) United States Patent
Stancescu

(10) Patent No.: US 11,453,036 B2
(45) Date of Patent: Sep. 27, 2022

(54) SHALLOW SINGLE PLATE STEEL TUB GIRDER

(71) Applicant: Samuel, Son & Co., Limited, Mississauga (CA)

(72) Inventor: Daniel Stancescu, Toronto (CA)

(73) Assignee: SAMUEL, SON & CO., LIMITED, Mississauga (CA)

( * ) Notice: Subject to any disclaimer, the term of this patent is extended or adjusted under 35 U.S.C. 154(b) by 2 days.

(21) Appl. No.: 16/901,045

(22) Filed: Jun. 15, 2020

(65) Prior Publication Data

US 2021/0017722 A1 Jan. 21, 2021

Related U.S. Application Data

(60) Provisional application No. 62/875,549, filed on Jul. 18, 2019.

(51) Int. Cl.

| | |
|---|---|
| ***B21B 1/095*** | (2006.01) |
| ***E01D 2/00*** | (2006.01) |
| ***E04C 3/07*** | (2006.01) |
| ***E01D 2/04*** | (2006.01) |
| ***E04C 3/293*** | (2006.01) |
| *E04C 3/04* | (2006.01) |

(52) U.S. Cl.

CPC ..... *B21B 1/095* (2013.01); *E01D 2/00* (2013.01); *E01D 2/04* (2013.01); *E04C 3/07* (2013.01); *E04C 3/293* (2013.01); *E04C 2003/0421* (2013.01); *E04C 2003/0473* (2013.01)

(58) Field of Classification Search

CPC .. B21B 1/095; B21B 1/08; B21B 1/22; B21B 2001/221; B21D 47/01; B21D 11/20

See application file for complete search history.

(56) References Cited

U.S. PATENT DOCUMENTS

| | | | | |
|---|---|---|---|---|
| 6,286,352 | B1 * | 9/2001 | Hackstock | B21D 5/08 72/167 |
| 6,871,462 | B2 | 3/2005 | Azizinamini | |
| 7,627,921 | B2 | 12/2009 | Azizinamini | |
| 9,915,045 | B1 | 3/2018 | Azizinamini | |
| 2015/0251234 | A1 * | 9/2015 | Daimaru | B21B 1/28 72/181 |
| 2018/0117653 | A1 * | 5/2018 | Huang | B21B 1/22 |

OTHER PUBLICATIONS

Michaelson, Gregory K., Ph.D., et al., Development of a shallow press-brake-formed steel tub girder for short-span bridge applications, Istanbul Bridge Conference, Aug. 8-10, 2016, Istanbul, Turkey.

TEGcivil, Standard Design and Details of Press-Brake-Formed Steel Tub Girder, Oct. 2017, www.constructbridge.com/ProductDetails.

(Continued)

*Primary Examiner* — Teresa M Ekiert

(74) *Attorney, Agent, or Firm* — Hodgson Russ LLP

(57) ABSTRACT

A shallow single plate cold roll formed steel tub girder member is fabricated from unheated steel plate material by a cold roll-forming process which eliminates longitudinal welds and induces camber in the tub girder member.

13 Claims, 4 Drawing Sheets

(56) References Cited

OTHER PUBLICATIONS

Texas Department of Transportation et al., Preferred Practices for Steel Bridge Design, Fabrication, and Erection, Jun. 1, 2019, //ftp.dot.state.tx.us/pub/txdot-info/library/pubs/bus/bridge/steel_bridge.pdf.
Short Span Steel Bridge Alliance, Short Span Steel Bridge Systems, Jun. 21, 2019, www.shortspansteelbridges.org.
Barth, Karl E., Ph.D., et al., Development and Experimental Validation of Composite Press Brake-Formed Modular Steel Tub Girders for Short-Span Bridges, Apr. 30, 2015, Journal of Bridge Engineering, vol. 20, No. 11, pp. 04015007-1 through 04015007-7.

* cited by examiner

PRE-TOPPED

FULL-DEPTH PANEL

PARTIAL DEPTH PANEL

SHALLOW SINGLE PLATE STEEL TUB GIRDER

FIELD OF THE DISCLOSURE

The present invention relates to steel tub girders, also known as box girders, used in building bridges.

BACKGROUND

Cast-in-place and precast concrete girders have been used for constructing and repairing bridges. Cast-in-place concrete girders require time-consuming pouring an curing operations to be carried out on-site, which is disruptive to traffic flow. Precast concrete girders are heavy and bulky, and thus expensive to transport from the casting facility to the construction site.

It is also known to fabricate tub girders for building short span and regular span bridges from steel. In a known method, a steel tub girder is fabricated by cutting top flanges, side webs, and a bottom flange of the tub girder from steel plate, and then welding the plate pieces together to form the tub girder. This technique is labor intensive due to the number of longitudinal welds involved and the associated weld inspection requirements. In addition, large fixtures are needed to stabilize the various pieces during welding to ensure dimensional tolerances are met in the fabricated tub girder.

More recently, tub girders have been fabricated using a press brake to form longitudinal bends in a length of steel sheet or plate material (for sake of simplicity, the term "plate material" will be used below to mean either sheet material or plate material). For example, in the case of a trapezoidal tub girder, a pair of parallel longitudinal bends are formed by the press brake to define the bottom flange and the webs, and another pair of longitudinal bends are formed to define the top flanges. The press brake fabrication technique has shortcomings. One shortcoming is that the overall length of commercial press brakes is limited, so the overall tub girder length is limited. The longest press brake machine known to applicant is sixty feet in length, so tub girders fabricated by press brake have an upper length limit of sixty feet. From a practical standpoint, there are very few press brake machines this long, and efforts to manufacture longer press brake machines have failed due to weight limitations and other engineering limitations. Given the length limitation of press brake formed tub girders, their use in constructing longer bridge decks requires a relatively large number of tub girder segments joined end-to-end by welding at the construction site. Here again, labor and quality inspection requirements reduce efficiency and drive up cost.

Another shortcoming associated with press brake tub girder fabrication is that the inner radius of each bend formed by the press brake can be no less that about five times the thickness of the plate material used to form the tub girder. Thus, for example, a tub girder formed of ½-inch thick plate material would require bends having a minimum radius of about 2½ inches.

A further shortcoming is that the press brake cannot induce positive camber (i.e. a slight arc or curvature) over the length of the tub girder as a way to counteract sagging near a midpoint region of the tub girder when a load is applied. In order to induce positive camber, a separate and very time consuming operation is required involving incremental bending of the tub girder starting from one end of the girder and proceeding approximately every six inches along the length of the girder until reaching the longitudinal midpoint of the girder, and then repeating the incremental bending procedure starting from the opposite end of the girder to meet at the longitudinal midpoint. In practice, meeting at the midpoint is quite difficult due to cumulative errors or differences which may be introduced at each longitudinal increment.

SUMMARY OF THE DISCLOSURE

The disclosed tub girder fabrication method uses a roll-forming process for cold forming steel plate material instead of a press-brake bending process or traditional fabrication from steel plates. The disclosed cold roll-forming method eliminates longitudinal welds, providing an advantage over traditional fabrication from steel plates.

The disclosed tub girder fabrication by cold roll-forming also overcomes the shortcomings of press brake fabrication mentioned above. According to an aspect of the present disclosure, a tub girder member is fabricated by cold roll-forming the tub girder member from a single piece of steel plate material. As a result, the tub girder member can have a significantly greater length as compared to a press-braked tub girder, thereby reducing the need for end-to-end welding of shorter tub girder segments at the construction site. The inner radius of each roll-formed bend can be about 1½ to 2 times the material thickness, which is much less than the inner radius possible with a press brake (about 5 times the material thickness). During the cold roll-forming process, a positive camber may be induced over the length of the tub girder member.

BRIEF DESCRIPTION OF THE DRAWINGS

The nature and mode of operation of the present disclosure will now be more fully described in the following detailed description taken with the accompanying drawing figures, in which.

DETAILED DESCRIPTION

Figure 1:
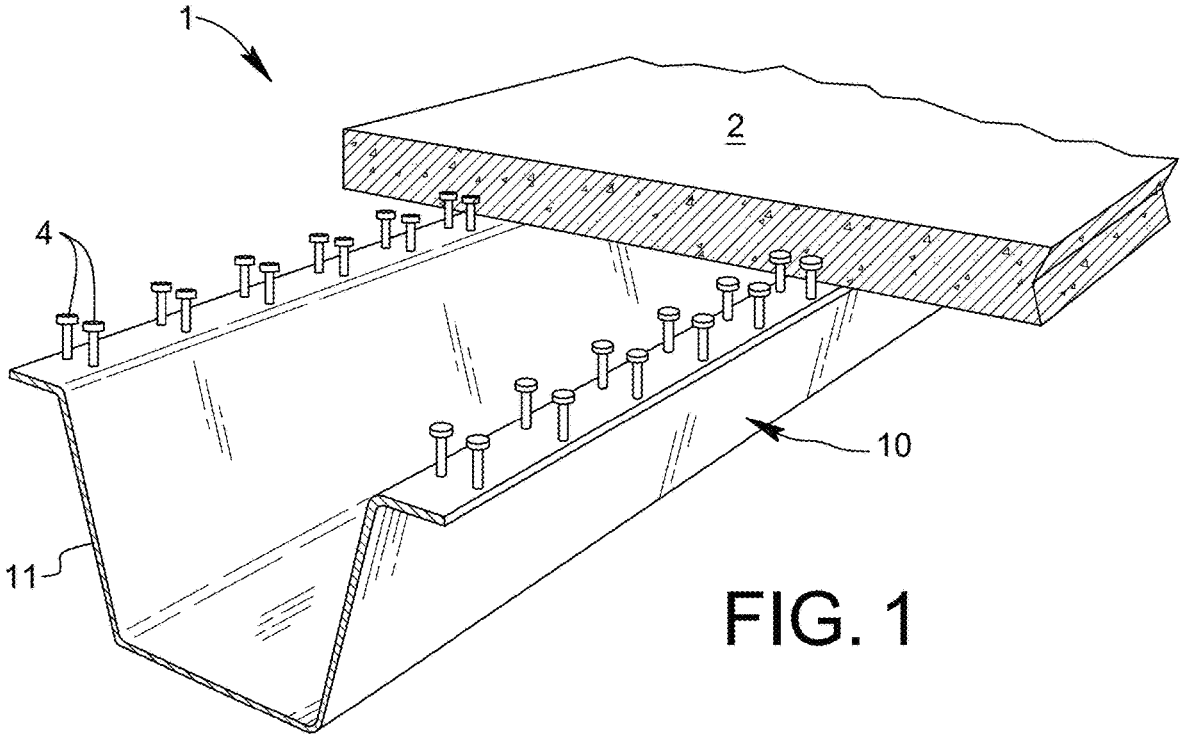
FIG. 1 is a sectioned perspective view of a bridge structure incorporating a bridge girder having a cold roll-formed tub girder member in accordance with an embodiment of the present disclosure.
Figure 2:
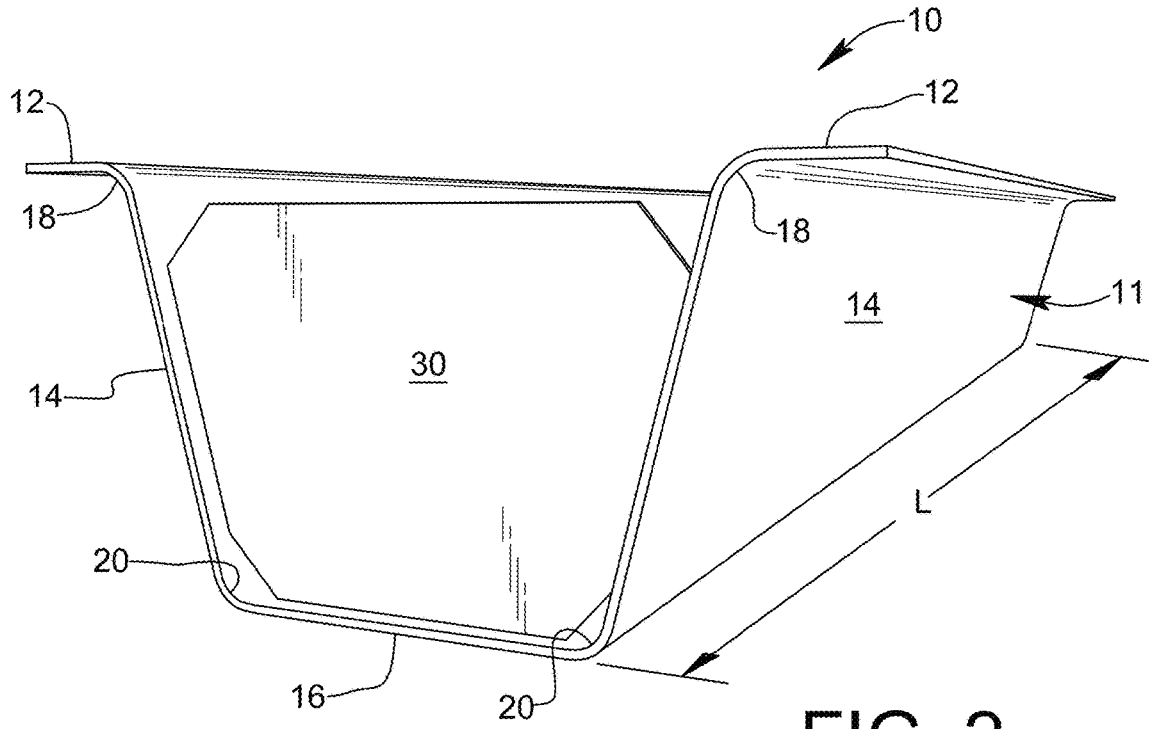
FIG. 2 is a perspective view of a bridge girder having a cold roll-formed tub girder member in accordance with an embodiment of the present disclosure.
Figure 3:
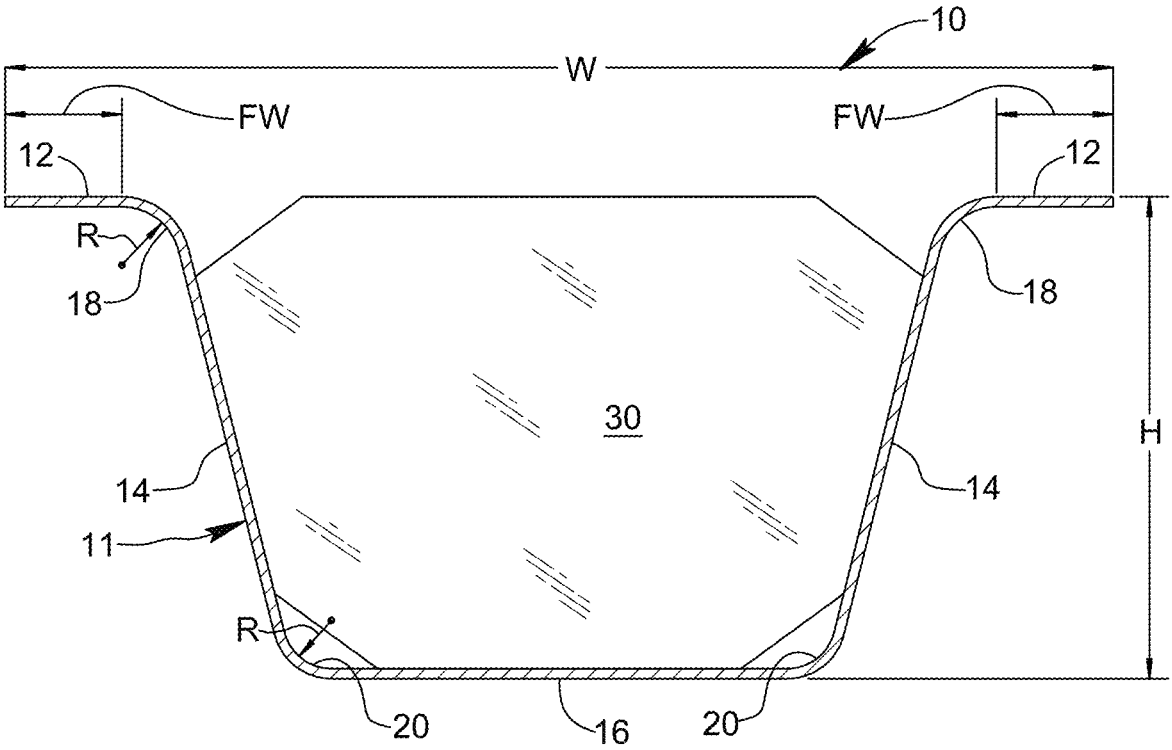
FIG. 3 is cross-sectional view of the bridge girder shown in FIG. 2.

FIG. 1 depicts a bridge structure 1 comprising a concrete bridge deck 2 supported by a bridge girder 10 which includes a cold roll-formed steel tub girder member 11 formed according to an embodiment of the present disclosure. Deck 2 may be attached to tub girder member 11 by shear studs 4. FIG. 2 shows an embodiment of bridge girder 10 without bridge deck 2, and FIG. 3 shows bridge girder 10 in cross-section. As will be understood, the length L of girder 10 shown in FIG. 3 extends in a direction perpendicular to the plane of the drawing sheet.

Tub girder member 11 may generally comprise a pair of top flanges 12, a pair of webs 14, and a bottom flange 16. Tub girder member 11 may further comprise a pair of upper bends 18 extending in a longitudinal direction of the tub girder member between each top flange 12 and the associated web 14, and a pair of lower bends 20 extending in the longitudinal direction of the tub girder member between each web 14 and the bottom flange 16.

Tub girder member 11 is fabricated by roll-forming unheated (i.e. not above room temperature) steel plate material having a predetermined width and thickness. The plate material may be precut to a desired length before roll-forming. Alternatively, the plate material may be roll-formed to provide the desired cross-sectional shape of tub girder member 11, and then cut to a desired length after roll-forming. Access ports (not shown) may be cut through bottom flange 16 of tub girder member 11 to allow for field inspection of bridge girder 10.

As a non-limiting example, ASTM A709 Grade 50 or Grade 50W steel plate may be cold roll-formed to produce tub girder member 11. Other steel grades, including stainless steel, may be used to form tub girder member 11. By way of further non-limiting example, ASTM A709 Grade 50CR (ASTM A1010) stainless steel, such as DURACORR® Grade 50 from ArcelorMittal USA, may be used to form tub girder member 11.

Figure 4:
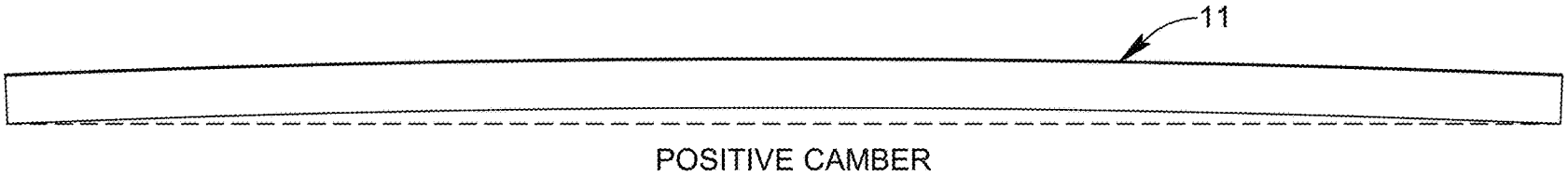
FIG. 4 is a side elevational view of a cold roll-formed tub girder member in accordance with an embodiment of the present disclosure, illustrating an induced positive camber in the cold roll-formed tub girder member.

As may be seen in FIG. 4, tub girder member 11 may have a positive camber induced in the girder member during the cold roll-forming process. Consequently, tub girder member 11 has an arcuate profile, and the longitudinal midpoint of girder member 11 is higher than the two longitudinal ends of the girder member. For many short span applications (e.g. county bridges), compensating for dead load deflection to prevent sag in the bridge is an important design consideration. This design consideration may be addressed by providing a positive camber in tub girder member 11 of bridge girder 10 during the cold roll-forming process, thereby avoiding a separate manufacturing operation for inducing camber.

Bridge girder 10 may further include one or more stiffening diaphragms 30 to provide torsional stiffness. For example, a diaphragm 30 may be provided near each opposite end of tub girder member 11. One or more additional diaphragms 30 may be provided at intermediate locations along tub girder member 11 if greater torsional stiffness is desired. Each diaphragm 30 may be cut from steel plate material, for example by a CNC machine, and welded to internal wall surfaces of webs 14 and bottom flange 16. Alternatively, bent steel plates or standard steel channels (e.g. MC channels) may be used as diaphragms 30 in an economical manner.

The cross-sectional dimensions of tub girder member 11 are subject to design choice. Steel plate material having a thickness within a range from ⅜" through ⅝" is suitable for practicing the invention, however other plate thicknesses may be used. The overall width W and height H of tub girder member 11 are related to the width of the steel plate material and the configuration of the roll-forming stations. Generally, for a given width of steel plate material, a deeper (i.e. higher) tub girder member 11 will be narrower in width than a shallower tub girder member 11. Steel plate material having a width within a range from 60" through 120" is suitable for practicing the invention, however other widths may be used depending on the desired cross-sectional dimensions of tub girder member 11. The radius R of each upper bend 18 and lower bend 20 may be 1½ times the plate thickness, or greater if desired. A flange width FW of about 6" and a web rise-to-run ratio of about 4:1 are generally suitable for practicing the invention, however variations may be adopted.

Because cold roll-forming is used to form tub girder member 11, the length L of bridge girder 10 is limited only by the length of available steel plate material. Currently, certain steel mills in the United States can produce ⅜" thick to ⅝" thick steel plate, up to 120" in width, in lengths of 90 feet or longer.

A positive camber of approximately ½" per ten feet of length may be induced in tub girder member 11 during cold roll-forming, however variations may be adopted. Thus, for example, in a girder 10 having an overall length L of 72 feet and a positive camber of ½" per ten feet of length, the longitudinal midpoint of bridge girder 10 is 3½" inches higher than the longitudinal ends of bridge girder 10. The degree of camber achievable through roll-forming is sufficient for a bridge.

Figure 5:
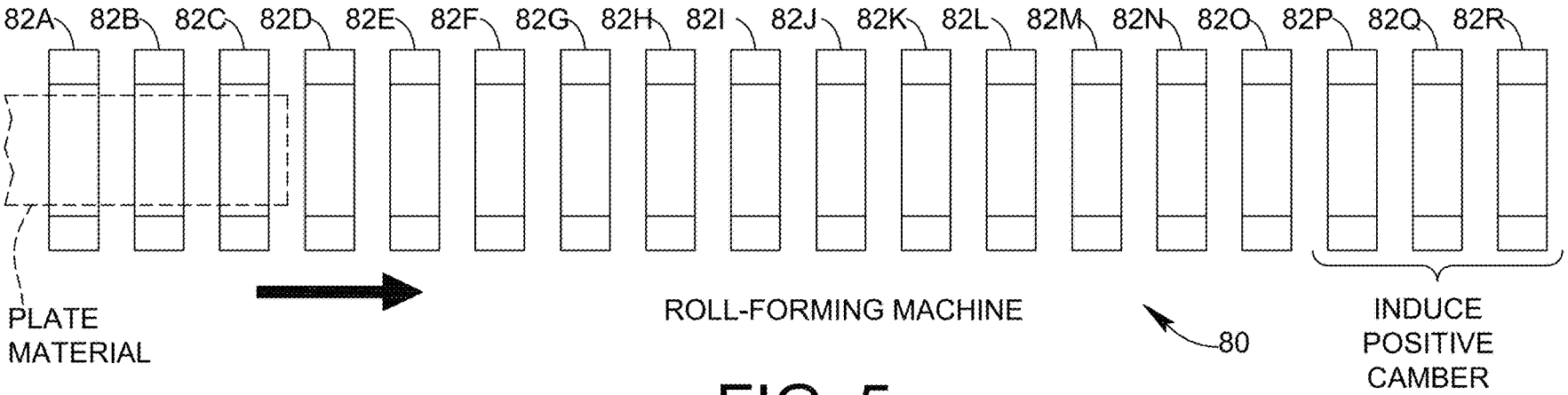
FIG. 5 is a schematic illustration of a roll-forming line apparatus for use in roll-forming a tub girder member in accordance with the present disclosure.
Figure 6:
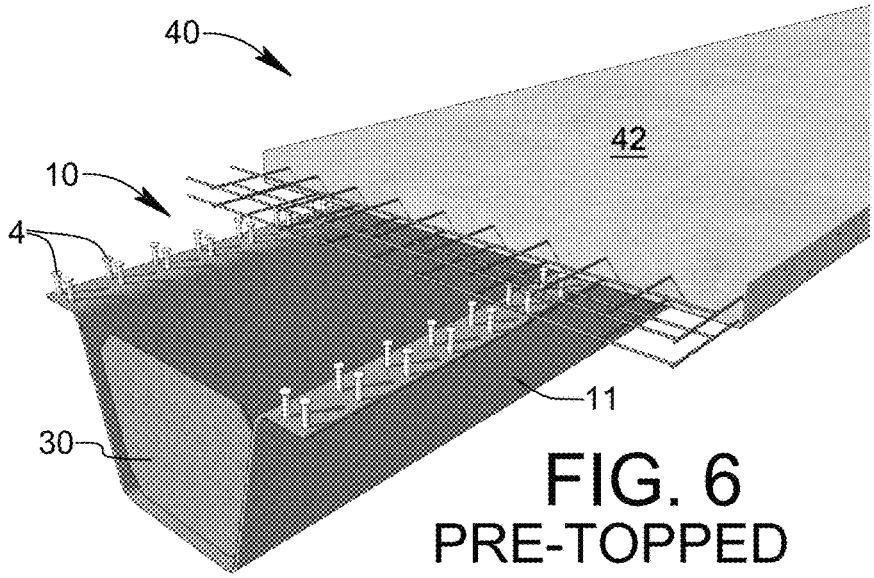
FIG. 6 is a partially sectioned perspective view showing a prefabricated bridge unit incorporating a cold roll-formed tub girder member in accordance with an aspect of the present disclosure, wherein the tub girder is pre-topped.

Reference is also made now to FIGS. 5 and 6. Each upper bend 18 and each lower bend 20 is formed by passing unheated plate material through a roll-forming machine 80 including a series of roll-forming stations 82A through 82R. Roll-forming stations 82A-82R have rollers which are set up and arranged to engage the steel plate material and progressively cold form each bend in a non-impact manner as the plate material advances through the roll-forming machine from one station to the next. The roll-forming machine may be set up to form both upper bends 18 and both lower bends 20.

To induce camber in tub girder member 11 during cold roll-forming, a series of three roll-forming stations may be specially configured for this purpose. For example, as indicated in FIG. 5, a series of three consecutive roll-forming stations such as the final stations 82P, 82Q, and 82R may be dedicated to inducing camber. The first station 82P may be set up to provide a fixed-roller anchor point, the second station 82Q may include one or more vertically-actuated rollers automatically moving up and down to engage the passing roll-formed plate material, and the third station 82R may be set up to provide another fixed-roller anchor point. The configuration of and distances between the roll-forming stations may be determined during a design phase using finite element analysis (FEA).

Shear studs 4 may be welded to top flanges 12 of roll-formed tub girder member 11.

Tub girder member 11 may be installed in a bridge assembly in an uncoated condition (uncoated weathering steel or "UWS"), whereby weathering of the uncoated steel provides corrosion protection. According to this approach, a protective oxide layer develops from wet/dry cycles. A less porous rust layer adheres more firmly to the base metal. The rate of corrosion is initially the same as ordinary steel and then decreases. This approach generally performs well for non-UWS bridges. During fabrication, no additional third party handling and transportation expenses are incurred, resulting in lower fabrication costs and shorter fabrication time. During use, maintenance requirements are minimal, no field painting is necessary, and the steel takes on a natural appearance. Overall, a lower life-cycle cost is realized.

Alternatively, when UWS is not an option, tub girder member 11 may be galvanized for corrosion protection. Galvanizing the tub girder member 11 is advantageous for providing corrosion protection against any moisture that could accumulate inside the tub girder member. In the galvanizing process, iron in the steel metallurgically reacts with molten zinc to form a tightly-bonded alloy coating that protects the steel from corrosion in harsh environments and provides maintenance-free longevity for decades, e.g. sixty years or more.

A bridge design may require multiple bridge girders 10 spaced laterally relative to one another, in which case external cross-frames may be installed in a known manner to connect the tub girder member 11 of one bridge girder to the tub girder member 11 of each laterally adjacent bridge girder 10. If deck 2 is provided as a precast deck, then the use of cross-frames may be unnecessary.

A bridge design may require multiple bridge girders 10 arranged end-to-end over the length of the bridge. Multiple bridge girders 10 may be installed in a longitudinally continuous arrangement through common methods already employed for bridge girders having press-brake formed tub girder members. These methods include "Simple for Dead—Continuous for Live" (SDCL), use of "link slabs" in the bridge deck to connect longitudinally adjacent bridge girders, and traditional bolted field splices.

As may be appreciated, bridge girders that use a cold roll-formed tub girder member 11 according to the present disclosure share benefits of bridge girders that use a traditional press brake-formed tub girder member. For example, it is possible to adhere to traditional AASHTO design specifications including AASHTO limits for bend radii. The sectional shape can be optimized to achieve maximum structural capacity. Commonly available steel plate may be utilized for fabrication, ensuring maximum availability and best price.

Advantages over concrete box beams, concrete slabs, and precast concrete girders—traditional choices for short span bridges—are also realized. Bridge girders 10 according to the present disclosure meet or exceed concrete box beams and precast concrete girders in two important key areas: structural depth and weight. Structural depth was important because a deeper section may mean a longer bridge structure or a wider offset. As may be seen in Table 1 below, bridge girders employing cold-formed (either press brake-formed or roll-formed) steel girder members match or exceed several of the comparable concrete box beams with respect to structural depth. Moreover, the heaviest cold-formed tub girder is about 57% lighter than the lightest concrete box beam.

TABLE 1

| | Cold Formed Steel Girder Weight | | Concrete Box Beam Weight* | |
|---|---|---|---|---|
| Plate Size Width x Thickness | Depth (inches) | Weight (lbs/ft) | Depth (inches) | Weight (lbs/ft) |
| 60" x 1/2" | 12 | 102 | 12 | 470 |
| 72" x 1/2" | 17 | 122 | 17 | 555 |
| 84" x 1/2" | 23 | 143 | 21 | 645 |
| 96" x 1/2" | 26 | 163 | 27 | 765 |

TABLE 1-continued

| | Cold Formed Steel Girder Weight | | Concrete Box Beam Weight* | |
|---|---|---|---|---|
| Plate Size Width x Thickness | Depth (inches) | Weight (lbs/ft) | Depth (inches) | Weight (lbs/ft) |
| 108" x 1/2" | 30 | 184 | 33 | 835 |
| 120" x 1/2" | 34 | 204 | 42 | 865 |

Box beam girder weights by Pre-stressed Services. 36" wide, Type B section

Weight becomes an important factor in bridge construction because a primary cost in building short span bridges is crane size and crane time, not just for setting beams but also for driving piles and any other necessary work. Consequently, with lighter bridge girders using steel tub girder members, there is less weight on the bridge foundation, shorter piles, and faster girder pick-ups, which all translate into overall smaller (less expensive) cranes.

Bridge girders 10 of the present disclosure have important benefits over bridge girders using press brake-formed tub girder members. Cold roll-forming increases production rate compared to press brake fabrication techniques, and provides greater flexibility in terms of the achievable overall length. Notably, cold roll-forming allows positive camber to be induced in a controlled manner during the forming process, whereas press brake-forming does not.

A bridge designer can chose to use a cast-in-place deck, a precast deck, or a steel plate/sandwich plate deck system (SPS) if weight is a factor. The choice between a cast-in-place deck and a precast deck often comes down to the logistics of shipping items to the bridge construction site. For example, four bridge girders 10 may be shipped on a single truck. By contrast, including a precast deck starts to limit shipping to one girder per truckload, meaning potentially four truckloads for the same bridge. Trying to ship the girders in pairs with a precast deck could create a load wider than twelve feet, depending on girder spacing, which adds permitting and scheduling challenges to the shipment.

Bridge girders 10 according to the present disclosure are lightweight, versatile, and ideal for standardized bridge designs, short span applications, Prefabricated Bridge Elements and Systems (PBES), Precast Bridge Units (PBUs), and Accelerated Bridge Construction (ABC) applications. Bridge girders 10 are torsionally rigid and provide excellent stability during erection and deck casting.

Figure 7:
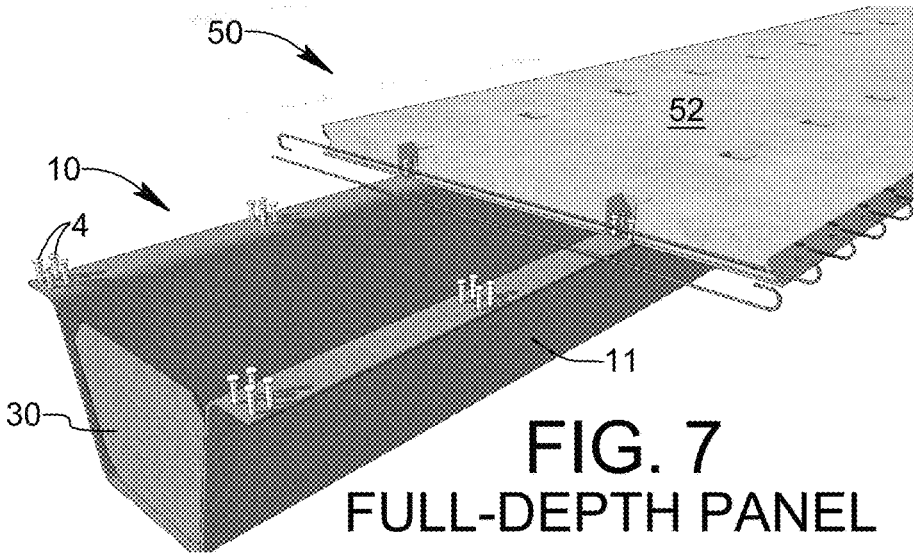
FIG. 7 is a partially sectioned perspective view showing a prefabricated bridge unit incorporating a cold roll-formed tub girder member in accordance with an aspect of the present disclosure, wherein the tub girder member supports a full-depth deck panel.
Figure 8:
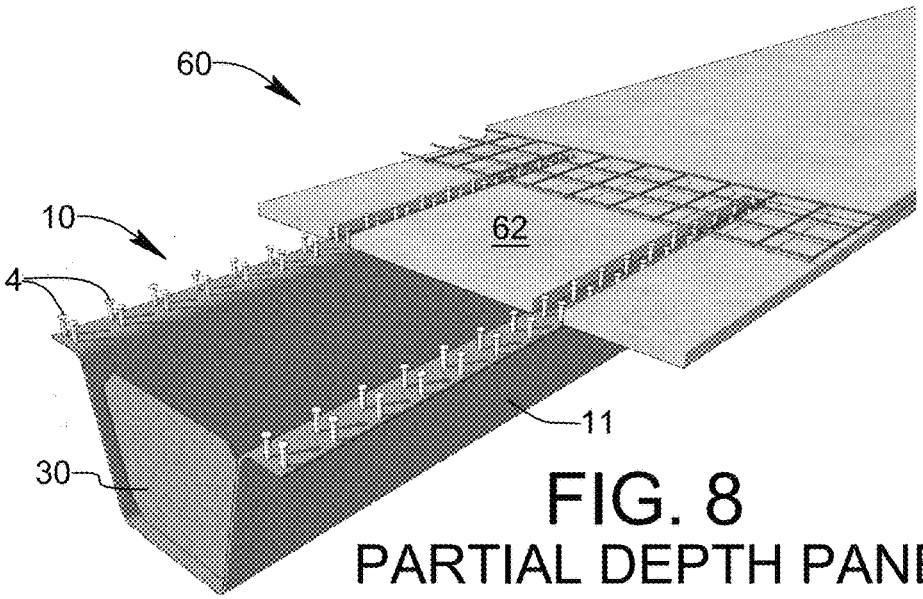
FIG. 8 is a partially sectioned perspective view showing a prefabricated bridge unit incorporating a cold roll-formed tub girder member in accordance with an aspect of the present disclosure, wherein the tub girder member supports a partial-depth deck panel.

FIGS. 6-8 respectively illustrate examples of various prefabricated bridge units 40, 50, and 60 which may incorporate one or more bridge girders 10 of the present disclosure. The depicted bridge units may be shipped with a full-depth and pre-topped concrete deck 42 (FIG. 6), a full-depth concrete deck panel 52 (FIG. 7) that is not topped, or a partial-depth concrete deck panel 62 (FIG. 8). Prefabricated bridge units 40, 50, 60 may be shipped individually or in pairs depending upon girder spacing and transportation width restrictions.

For example, prefabricated bridge unit 40 (pre-topped) may be shipped in a fully assembled condition to the bridge site, whereas prefabricated bridge units 50 and 60 may be shipped in a dissembled condition and assembled at the bridge site. For example, bridge girders 10 may be stacked into one another for transportation in one load and deck panels 52 or 62 may be transported in another load. Prefabricated units 40, 50, and 60 offer advantages over precast double-tee systems and deck bulb tee systems due to reduced shipping weight of the units.

Prefabricated bridge units 40, 50, 60 may be erected to form a complete bridge in a matter of hours. The bridge may be opened to traffic once connections at the deck edges are completed.

While the disclosure describes various exemplary embodiments, the detailed description is not intended to limit the scope of the disclosure to the particular forms set forth. The disclosure is intended to cover such alternatives, modifications and equivalents of the described embodiment as may be apparent to one of ordinary skill in the art.

What is claimed is:

1. A method of manufacturing a steel tub girder member comprising:

configuring a roll-forming machine (80) having a plurality of roll-forming stations (82A-82R) to form a pair of external upper longitudinal bends (18) and a pair of internal lower longitudinal bends (20);

passing unheated steel plate material through the roll-forming machine, wherein at least some of the plurality of roll-forming stations progressively cold form the upper longitudinal bends and the lower longitudinal bends to produce the steel tub girder member; and configuring a subset of the plurality of roll-forming stations to induce a positive camber in the unheated steel plate material as the unheated steel plate material is passing through the roll-forming machine;

wherein the subset of the plurality of roll-forming stations includes a first station (82P) configured to provide a fixed-roller anchor point, a second station (82Q) including at least one vertically-actuated roller configured to automatically move up and down to engage the unheated steel plate material, and a third station (82R) configured to provide another fixed-roller anchor point.

2. The method according to claim 1, further comprising: cutting the unheated steel plate material to a desired length.

3. The method according to claim 2, wherein the positive camber is approximately ½ inch per ten feet of length of the tub girder member.

4. The method according to claim 2, wherein the desired length is greater than sixty feet.

5. The method according to claim 4, wherein the desired length is at least seventy-two feet.

6. The method according to claim 5, wherein the desired length is at least ninety feet.

7. The method according to claim 2, wherein the step of cutting the unheated steel plate material is performed before the step of passing the unheated steel plate material through the roll-forming machine.

8. The method according to claim 2, wherein the step of cutting the unheated steel plate material is performed after the step of passing the unheated steel plate material through the roll-forming machine.

9. The method according to claim 1, wherein the unheated steel plate material has a plate thickness, and each of the upper longitudinal bends is cold formed to have a bend radius which is less than five times the plate thickness.

10. The method according to claim 9, wherein each of the upper longitudinal bends is cold formed to have a bend radius which is approximately 1½ times the plate thickness.

11. The method according to claim 1, wherein the unheated steel plate material has a plate thickness, and each of the lower longitudinal bends is cold formed to have a bend radius which is less than five times the plate thickness.

12. The method according to claim 11, wherein each of the lower longitudinal bends is cold formed to have a bend radius which is approximately 1½ times the plate thickness.

13. The method according to claim 1, wherein the fixed-roller anchor points of the first and third stations engage opposite longitudinal ends of the unheated steel plate material and the vertically-actuated roller of the section station engages a longitudinal midpoint of the unheated steel plate material member to induce the positive camber in the unheated steel plate material.

* * * * *